US007871494B2

(12) United States Patent
Viaser

(10) Patent No.: US 7,871,494 B2
(45) Date of Patent: Jan. 18, 2011

(54) DROP-OUT STEAM PROFILING CARTRIDGE

(75) Inventor: Glen John Viaser, North Vancouver (CA)

(73) Assignee: Honeywell ASCa Inc., Mississauga (CA)

( * ) Notice: Subject to any disclaimer, the term of this patent is extended or adjusted under 35 U.S.C. 154(b) by 487 days.

(21) Appl. No.: 12/008,246

(22) Filed: Jan. 9, 2008

(65) Prior Publication Data

US 2009/0173466 A1 Jul. 9, 2009

(51) Int. Cl.
*D21G 9/00* (2006.01)

(52) U.S. Cl. ..... 162/207; 162/290

(58) Field of Classification Search ..... 162/199, 162/207, 252, 289, 272, 275, 280, DIG. 6; 34/114, 446, 451, 568; 700/127–129; 100/333
See application file for complete search history.

(56) References Cited

U.S. PATENT DOCUMENTS

| | | | |
|---|---|---|---|
| RE28,968 | E | 9/1976 | Dove |
| 4,351,700 | A | 9/1982 | Dove |
| 4,398,355 | A | 8/1983 | Dove |
| 4,444,622 | A | 4/1984 | Dove |
| 4,767,935 | A | 8/1988 | Anderson et al. |
| 4,786,817 | A | 11/1988 | Boissevain et al. |
| 4,982,334 | A | 1/1991 | Balakrishnan |
| 5,022,966 | A | 6/1991 | Hu |
| 5,539,634 | A | 7/1996 | He |
| 5,711,087 | A | 1/1998 | Pazdera |
| 5,798,026 | A | 8/1998 | Wacinski et al. |
| 6,408,534 | B1 | 6/2002 | Alen et al. |
| 2006/0107704 | A1 | 5/2006 | Passiniemi |

FOREIGN PATENT DOCUMENTS

| | | | |
|---|---|---|---|
| CA | 1240142 | A | 8/1988 |
| CA | 2185889 | A1 | 7/1996 |
| CA | 2185891 | A1 | 7/1996 |
| DE | 10154828 | * | 5/2003 |
| EP | 1310591 | A2 | 5/2003 |
| WO | WO 99/41450 | * | 8/1999 |

* cited by examiner

*Primary Examiner*—Eric Hug
(74) *Attorney, Agent, or Firm*—Cascio Schmoyer & Zervas

(57) ABSTRACT

A steam distributor for applying steam to a continuously moving paper sheet employs one or more drop-out steam profiling cartridges. Each cartridge is connected to a steam distribution apparatus and includes a number of profiling zones that are covered by a contoured, smooth profiling screen from which steam is applied. The profiling screens are welded to baffles which enhances the structural integrity of the cartridge. No external clamps or other devices are employed that would otherwise disrupt the smooth, curved exterior surface of the profiling screens. The spaced-apart baffles also eliminate the spilling over of steam from one profiling zone to the next which has the effect of minimizing the response width for steam profiling control. The use of the drop-out cartridges permits quick and easy removal of the profiling screens for change-out or cleaning.

20 Claims, 2 Drawing Sheets

DROP-OUT STEAM PROFILING CARTRIDGE

FIELD OF THE INVENTION

The present invention generally relates to a steam distributor for applying steam to a continuously moving paper sheet wherein the steam distributor includes one or more drop-out steam profiling cartridges. Each cartridge, which is attached to the steam distributor with bolts, features a number of profiling zones that are covered by a contoured, smooth profiling screen from which steam is applied. Employment of drop-out cartridges affords quick and easy removal of the profiling screens for change-out or cleaning.

BACKGROUND OF THE INVENTION

The steam heating of a paper sheet is widely practiced in papermaking. The increase in sheet temperature that results provides increased drainage rates for the water thus reducing the amount of water to be evaporated in the drier section. Water drainage is improved by the application of steam principally because the heating of the sheet reduces the viscosity of the water, thus increasing the ability of the water to flow. Most of the heat transfer takes place when the steam condenses in the sheet. The condensation of the steam transforms the latent heat of the steam to sensible heat in the water contained by the sheet.

A particular advantage of the steam heating of the paper sheet is that the amount of steam applied may be varied across the width of the sheet along the cross machine direction so that the cross machine moisture profile of the sheet may be modified. This is usually carried out to ensure that the moisture profile at the reel is uniform. Techniques in the papermaking art for sensing the moisture profile of a sheet of paper are well known. If a sensing apparatus is positioned over the paper sheet, downstream of a steam distributor able to control the moisture profile, then after measuring the water profile in the sheet, steam can be applied in varying amounts on a selective basis across the sheet, thus achieving the required uniform moisture profile at the reel.

It is known to divide a steam distributor into compartments and to control the supply of steam to each compartment, thus controlling the moisture profile of the sheet. Fiber and dirt accumulate within the compartments and over time, the debris penetrates into the internal structures and interferes with steam flow. The steam distributor must be disassembled in order to clean the internal components.

U.S. Pat. No. 5,711,087 to Pazdera describes an apparatus for distributing steam to a paper web or calendar roll which includes a removable curved-shaped profile screen. The screen is mounted on the apparatus with clip members that interrupt the otherwise smooth exterior surface of the screen. In addition, the use of external clip members makes the removable screen susceptible to flexing outward with increasing steam pressure. Moreover, the clamped edge of the screens must often be separated from the clips on the frame using jarring force, then pried back into place. When they are reattached, the screens lose the intended tight fit against the baffles thereby allowing significant leakage between profiling zones. Finally, in these prior art designs where the screens are not permanently attached, the steam holes in the screen must be situated near either the leading or trailing edge of the steambox in order to minimize the machine direction (MD) length of the screen. Consequently, if a screen becomes too long in the MD, the screen tends to bow out which causes excessive and inconsistent leakage between profiling zones. These removable screen plates become warped and battered after only a few cleaning routines.

U.S. Patent Application 2006/0107704 to Passiniemi describes a steam distribution apparatus that is partitioned into a number of discharge chambers and includes screen plates which are welded to the partitions to prevent the screen plates from twisting or flexing. While the apparatus includes sealable slots for access to the internal compartments for cleaning, the slots afford only limited access.

SUMMARY OF THE INVENTION

The present invention is based in part on the development of a removable drop-out steam profiling cartridge that can be incorporated as part of a steam distribution apparatus. The cartridge is preferably fastened to the apparatus by bolts that are readily accessible from the back side of the apparatus. On its front side, the cartridge defines a plurality of isolated steam profiling zones that are separated by spaced-apart partitions or baffle panels that essentially eliminate the spilling over of steam from one profiling zone to the next. The profiling zones are covered by steam profiling screens having perforations through which steam exits. The profiling screens are welded to the baffles which enhances the structural integrity of the drop-out steam profiling cartridge. No external clamps or other devices are employed that would otherwise disrupt the smooth, curved exterior surface of the profiling screens. The drop-out cartridge design provides a rigid structure for cleaning.

Accordingly, one aspect of the invention is directed to an apparatus to distribute steam onto a moving sheet, the apparatus having a leading edge and a trailing edge relative to the moving sheet, the apparatus including:

an elongated steam chamber which has a front wall that defines a recess region;

a plurality of conduits each having an inlet located in the elongated steam chamber and an outlet;

a removable cartridge that is positioned in the recess region wherein the cartridge defines a plurality of compartments each of which is in communication with an outlet and wherein the cartridge has a front screen having a plurality of apertures through which steam can exit;

means for regulating the flow of steam through the inlet and outlet of each conduit; and means for securing the removable cartridge to the recess region.

In another aspect, the invention is directed to an apparatus to distribute steam onto a continuously moving sheet that has an exterior contour wherein the apparatus has a leading edge and a trailing edge relative to the moving sheet, the apparatus including:

an elongated steambox header which has a front surface facing the moving sheet that defines a recess region;

a plurality of conduits each having an inlet located in the elongated steambox header and an outlet;

one or more removable cartridges that are juxtaposed along the length of the recess region wherein each cartridge comprises a frame that is partitioned along its length to form a plurality of profiling zones each of which is in communication with an outlet and wherein the frame has a front screen having apertures through which steam can exit and the screen defines an outer profiling surface with a contour conforming to the exterior contour of the moving sheet and which is flush with an exterior surface of the front surface of the elongated steambox header;

means for independently regulating the flow of steam through the inlet and outlet of each conduit; and means for fastening each removable cartridge to the elongated steambox header characterized in that each cartridge can be unfastened from a back side of the steambox header.

In a further aspect, the invention is directed to a method of distributing steam onto a continuously moving sheet which includes the steps of:

(a) positioning an apparatus having a leading edge and a trailing edge relative to the moving sheet, wherein the apparatus comprises:

(i) an elongated steam chamber that is in communication with a source of steam and which has a front wall that defines a recess region;

(ii) a plurality of conduits each having an inlet located in the elongated steam chamber and an outlet;

(iii) a removable cartridge that is positioned in the recess region wherein the cartridge defines a plurality of compartments each of which is in communication with an outlet and wherein the cartridge has a front screen having a plurality of apertures through which steam can exit;

(iv) actuators for regulating the flow of steam through the inlet and outlet of each conduit; and (v) means for securing the removable cartridge to the recess region; and (b) activating the actuators to allow steam through the conduits thereby delivering steam onto the moving sheet.

DETAILED DESCRIPTION OF PREFERRED EMBODIMENTS

Figure 1A:
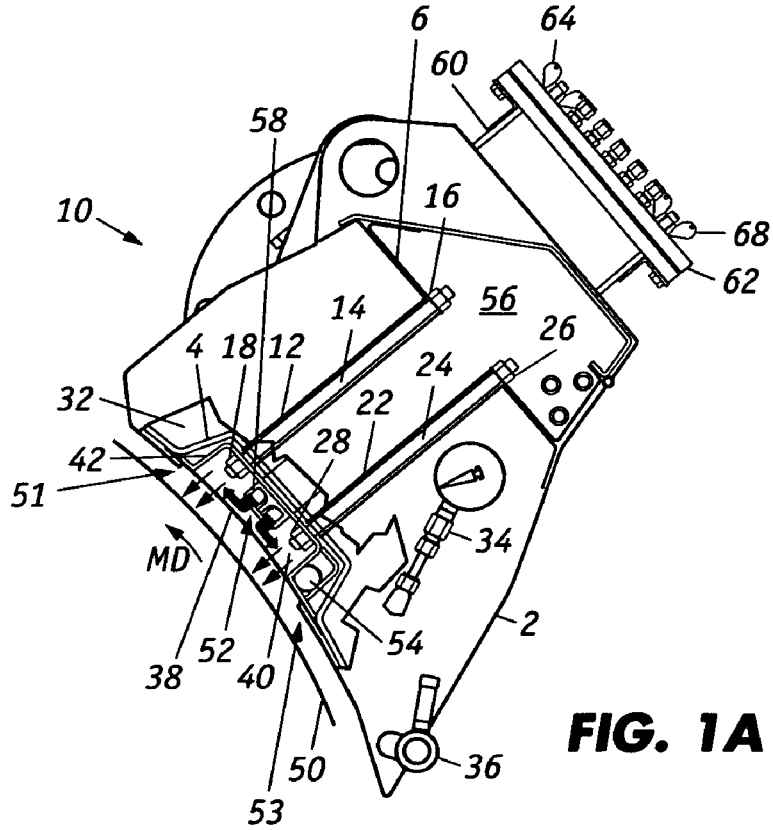
FIG. 1A is a cross sectional side view of a partially exposed portion of the steam distributor apparatus as steam is applied onto the surface of a moving sheet of paper that is supported on a roller.

FIG. 1A illustrates a steam distributor apparatus 10 that is particularly suited for applying steam to a paper web or calendar roll in a sheet making process. Papermaking devices are well known in the art and are described, for example, in U.S. Pat. No. 5,539,634 to He and U.S. Pat. No. 5,022,966 to Hu, U.S. Pat. No. 4,982,334 to Balakrishnan, U.S. Pat. No. 4,786,817 to Boissevain et al., and U.S. Pat. No. 4,767,935 to Anderson et al. which are incorporated herein by reference.

Apparatus 10 includes housing or steambox 2 that encloses a main steam distribution header 32 which runs the length of the apparatus and which is connected to at least one source of steam (not shown). Steam distribution header 32 includes an interior wall 6 and an exterior wall 4 which defines an exterior recess region into which is a drop-out steam profiling cartridge 42 is inserted and attached. A pair of pipes 12, 22 is welded onto interior wall 6 and exterior wall 4; each pipe is configured to provide a conduit or passageway through which a cartridge bolt can be inserted to fasten drop-out cartridge 42. Specifically, cartridge bolts 14, 24 are inserted through pipes 12, 22, respectively, and cartridge 42 includes two corresponding threaded mating nuts 18, 28, that are welded thereto, and that receive the distal ends of cartridge bolts 14, 24, respectively. Cartridge 42 is fastened by tightening cartridges bolts 14, 24 whose proximal ends 16, 26 are readily accessible through an inner enclosure 56 located at the back of steam distribution apparatus 10. By removing wing-nuts 64, 68, cover 62 can be removed from flange 60 to expose enclosure 56.

Steam exiting an opening 52 of valve sleeve 58 expands into the compartment or profiling zone 40 within cartridge 42 before being discharged through perforations in a profiling screen 38 and onto paper sheet 50 which is transported on a continuously rotating roll, for example. In this fashion, there is uniform steam distribution from a leading edge 51 to a trailing edge 53 of contoured profiling screen 38 as the sheet of material moves across profiling zone 40 in the machine direction. Condensate that forms on the bottom of profiling zone 40 seeps through a drain hole 54 and out through a condensate drain. The steam distributor apparatus is also equipped with a pressure gauge 34 and a main header condensate drain 36.

The exterior or front surface of profiling screen 38 is preferably contoured to match the shape of paper sheet 50. In this case, the concave-shaped curvature of profiling screen 38 is particularly suited for applying steam to a roll of material. The gap or distance between profiling screen 38 and paper sheet 50 typically ranges from 10 mm to 20 mm. The exterior surface of profiling screen 38 is flush with the outer, front surface of housing 2. At the perimeter where the edges of cartridge 42 meet the edge of the recess region, silicone fillers are not needed to create a smooth continuous surface.

Figure 1B:
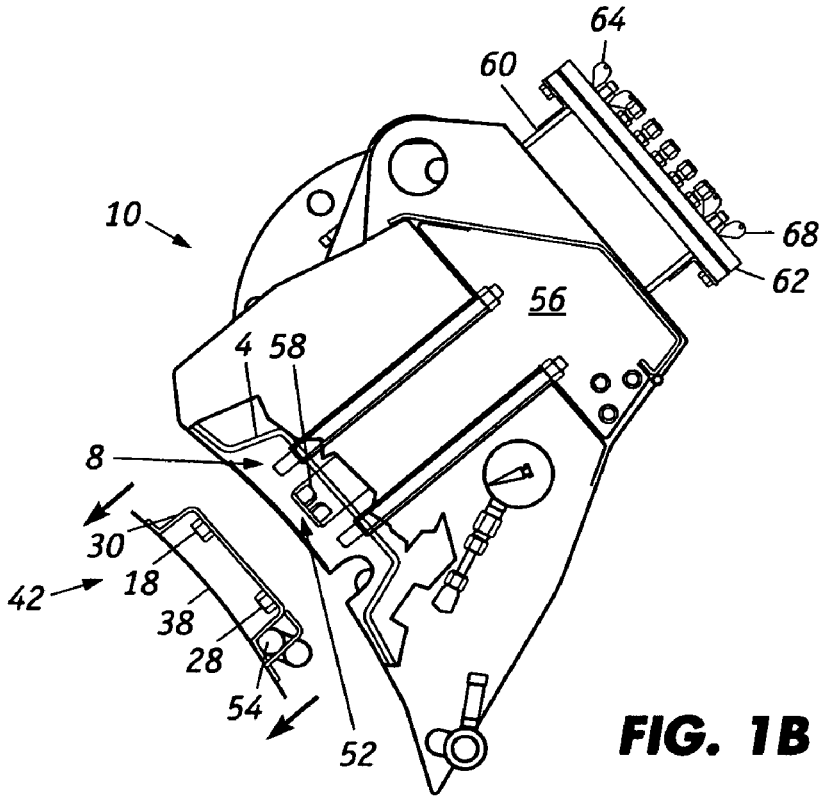
FIG. 1B is a cross sectional side view of a partially exposed portion of the steam distributor apparatus showing the drop-out steam profiling cartridge removed.

FIG. 1B shows the steam distribution apparatus with cartridge 42 removed from recess region 8 that is configured within exterior wall 4. This can be readily accomplished by loosening cartridge bolts 14, 24 to disengage the bolts from threaded nuts 18, 28, respectively. Cartridge 42 is preferably configured as a U-Shaped frame 30 that is covered by profiling screen 38 that has perforations or apertures that are sized and distributed to allow steam to discharge through in a predetermined pattern. Steam distributor apparatus 10 also includes a plurality of actuators each of which regulates the amount of steam which is discharged through an opening 52 of valve sleeve 58. The use of cartridge bolts 14, 24 to secure drop-out cartridge 42 and to maneuver profiling screen 38 into U-Shaped frame 30 permits design and manufacturing tolerances to be flexible without sacrificing performance of the steam distributor apparatus. The manufacturing process can be more readily streamlined.

Figure 2:
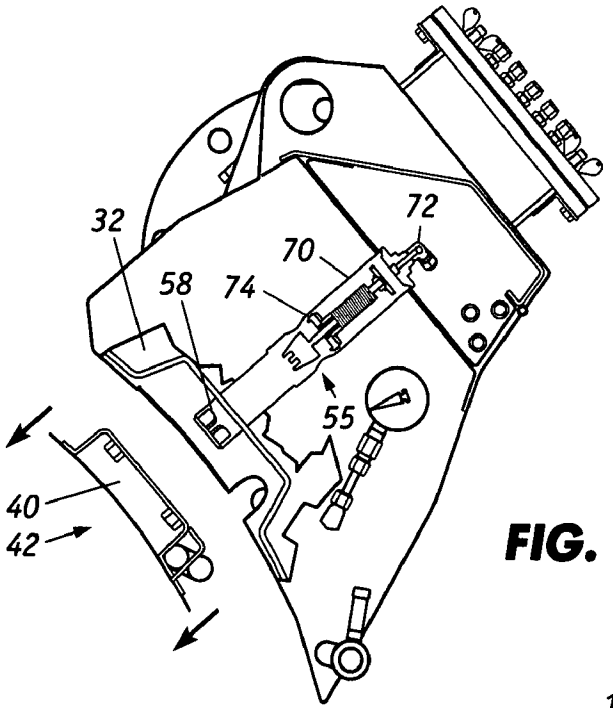
FIG. 2 is a cross sectional side view of a partially exposed portion of the steam distributor apparatus showing an actuator.

As shown in FIG. 2, high pressure steam that is supplied to main steam distribution header 32 is drawn into valve sleeve 58 through an annular opening 55 that is located between the valve sleeve 58 and pipe 74. The amount of steam drawn is controlled by actuator 70 which is connected via connector 72 to a pneumatic supply which tunes or regulates the actuator by pressurizing a diaphragm that is on top of a piston that is located inside actuator 70. The piston is connected to a measuring plug that moves inside pipe 74 to control the amount of steam that goes into a profiling zone 40 within cartridge 42. Pneumatic actuators for regulating steam flow in a steam distribution apparatus are described, for instance, in U.S. Pat. No. 4,398,355 to Dove and U.S. Pat. No. 4,351,700 to Dove, which are incorporated herein by reference.

By monitoring and controlling the steam flow into each of a plurality of profiling zones 40, a predetermined steam profile can be injected onto a sheet along its cross direction. The steam profile, as measured along the length of the steam distribution apparatus, can be uniform or non-uniform so that the sheet or web of material can be exposed to a steam curtain having different amounts of steam in the cross direction.

Figure 3:
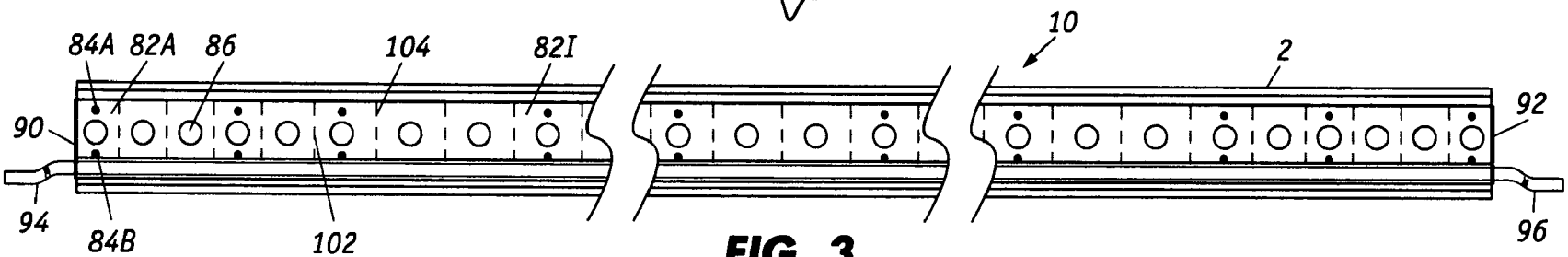
FIG. 3 is front view of the steam distribution apparatus illustrating the profiling compartments or zones and the positions of the cartridge bolts and steam discharge conduits.

FIG. 3 illustrates a front view of steam distributor apparatus 10 exposing the compartment of the drop-out steam profiling cartridges without the profiling screens. Housing 2, which is flanked by endplates 90, 92, forms an elongated structure having a front wall configured to serve as a recess region into which one or more drop-out steam profiling cartridges are secured. An external source of steam is connected through steam line 94 to steam distribution apparatus 10 and excess steam in the form of condensate exits through drain 96.

As illustrated, a plurality of steam profiling zones or compartments spans the length of steam distributor apparatus 10. Steam is supplied to each compartment via an opening 86 of a valve sleeve. The compartments are isolated from one another by zone dividers or baffles 102, 104 which are spaced apart laterally and to which a stream profiling screen 38 (FIG. 1B) is welded. Baffles 102, 104 also serve as internal gussets onto which U-Shaped frame 30 (FIG. 1B) of the drop-out steam profiling cartridge 42 (FIG. 1B) is welded. In this fashion, the steam profiling screen is held in place so as not to flex or expand outwardly and possibility come into contact with the paper sheet should the pressure in the compartment increase suddenly. In addition, the baffles prevent the spill-over of steam between steam profiling zones which minimizes the overall response width in the process of monitoring and controlling the steam profile. Since the steam profiling screen is welded to the cartridge, the screen can withstand a higher pressure from the steam jet at the actuator outlet than with conventional designs. For example, steam jet 52 may be allowed to impact steam profiling 38 screen directly without the need for a protective plate as illustrated in FIGS. 1A and 1B. As a result, a higher range of pressure distribution within the profiling zones or compartments can be achieved.

The structural integrity of the drop-out cartridge allows for optimal machine-direction placement of the perforations in profiling screen 38 (FIG. 1B). In particularly, unlike prior designs where the perforations are restricted primarily to the leading or trailing edges of the steambox, with the drop-out steam profiling cartridge, the screen holes can be moved to the center of the contoured surface. This feature may be beneficial in reducing the cross-directional response width (fanning out) of the process.

As described above, cartridge bolts are positioned along the length of the apparatus to secure the drop-out steam profiling cartridge. As shown in FIG. 3, the bolts are connected to nuts, such as nuts 84A and 84B located in compartment 82A. As depicted, pairs of bolts are spaced apart along the length of the apparatus; however, in order to fasten a cartridge to steam distributor apparatus 10, it is not necessary that a pair of bolts be associated with each compartment.

The recess region is designed to accommodate one or more drop-out steam profiling cartridges. In the case where a single integral cartridge is employed, its length would essentially match that of the recess region. Alternatively, a plurality of shorter cartridges, which are individually inserted into the recess region and secured thereto, can be employed. The use of multiple smaller cartridges allows for selective removal for maintenance. For example, a sectioned cartridge that includes 9 steam profiling zones 82A through 82I is positioned in the recess region adjacent endplate 90. Other sectional cartridges are then positioned in the recess region to form a series of sectional cartridges juxtaposed from end to end.

One benefit of employing sectional cartridges is that a fixed design unit can be more readily based-lined with conventional 3-D modeling and parameterized computer-aided design (CAD) software. Furthermore, once a design unit is dimensionally fixed, it can be used in the design of various steam distribution apparatuses. Finally, employing a drop-out steam profiling cartridge simplifies the overall design of the accompanying steambox header by reducing the number of internal channels. In particular, with comparable prior art steambox headers that accommodate removable steam profiling screens, a higher number of internal channels must be welded to the steambox headers in order to allow the removable screens to be positioned properly while maintaining the required contour of the steambox front side.

The length of steam distribution apparatus 10 typically corresponds to the width of the sheet or web to which steam is to be applied. For papermaking, the length generally ranges from 5 to 12 meters and typically is about 9 meters. Each steam profiling zone, e.g., 82A in FIG. 3, has a width of about 3 in. (7.6 cm) to 4 in. (10.2 cm). A typical steam distribution apparatus has up to about 90 steam profiling zones in total. In operation, the steam pressure in each profiling zone ranges up to about 80 kPa.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An apparatus to distribute steam onto a moving sheet, the apparatus having a leading edge and a trailing edge relative to the moving sheet, the apparatus comprising:

an elongated steam chamber which has a front wall that defines a recess region;

a plurality of conduits each having an inlet located in the elongated steam chamber and an outlet;

a removable cartridge that is positioned in the recess region wherein the cartridge defines a plurality of compartments each of which is in communication with an outlet and wherein the cartridge has a front screen having a plurality of apertures through which steam can exit;

means for regulating the flow of steam through the inlet and outlet of each conduit; and means for securing the removable cartridge to the recess region such that the cartridge is fastened to the front wall of the elongated steam chamber.

2. The apparatus of claim 1 wherein the cartridge comprises a frame defining an elongated channel that is partitioned to form the plurality of compartments which function as profiling zones.

3. The apparatus of claim 2 wherein each profiling zone is isolated from adjacent profiling zones so that steam in one profiling zone does not flow directly to an adjacent profiling zone.

4. The apparatus of claim 3 wherein the elongated channel is U-shaped.

5. The apparatus of claim 2 wherein the frame is covered with the front screen that defines an outer profiling surface with a contour conforming to that of the moving sheet.

6. The apparatus of claim 5 wherein the outer profiling surface is flush with an exterior surface of the front wall of the elongated steam chamber.

7. The apparatus of claim 1 comprising a plurality of bolts that fasten the cartridge to the front wall of the elongated steam chamber.

8. The apparatus of claim 7 further comprising a plurality of pipes that are secured to the apparatus wherein each pipe defines a conduit through which a bolt is positioned.

9. The apparatus of claim 7 wherein the cartridge comprises a frame that includes a plurality of fasteners to which the plurality of bolts is connected.

10. The apparatus of claim 1 wherein the means for regulating the flow of steam through the inlet and outlet of each conduit comprises a plurality of actuators.

11. An apparatus to distribute steam onto a continuously moving sheet that has an exterior contour wherein the apparatus has a leading edge and a trailing edge relative to the moving sheet, the apparatus comprising:

an elongated steambox header which has a front surface facing the moving sheet that defines a recess region;

a plurality of conduits each having an inlet located in the elongated steambox header and an outlet;

one or more removable cartridges that are juxtaposed along the length of the recess region wherein each cartridge comprises a frame that is partitioned along its length to form a plurality of profiling zones each of which is in communication with an outlet and wherein the frame has a front screen having apertures through which steam can exit and the screen defines an outer profiling surface with a contour conforming to the exterior contour of the moving sheet and which is flush with an exterior surface of the front surface of the elongated steambox header;

means for independently regulating the flow of steam through the inlet and outlet of each conduit; and means for fastening each removable cartridge to the elongated steambox header characterized in that each cartridge can be unfastened from a back side of the steambox header.

12. The apparatus of claim 11 wherein each removable cartridge is secured to the elongated steambox header by one or more bolts.

13. The apparatus of claim 12 further comprising a plurality of pipes that are secured to the apparatus wherein each pipe defines a passageway through which a bolt is positioned.

14. The apparatus of claim 12 wherein each cartridge comprises a frame that includes a plurality of fasteners to which the plurality of bolts is connected.

15. The apparatus of claim 11 wherein the means for independently regulating the flow of steam through the inlet and outlet of each conduit comprises a plurality of actuators.

16. A method of distributing steam onto a continuously moving sheet which comprises the steps of:

(a) positioning an apparatus having a leading edge and a trailing edge relative to the moving sheet, wherein the apparatus comprises:

(i) an elongated steam chamber that is in communication with a source of steam and which has a front wall that defines a recess region;

(ii) a plurality of conduits each having an inlet located in the elongated steam chamber and an outlet;

(iii) a removable cartridge that is positioned in the recess region wherein the cartridge defines a plurality of compartments each of which is in communication with an outlet and wherein the cartridge has a front screen having a plurality of apertures through which steam can exit;

(iv) actuators for regulating the flow of steam through the inlet and outlet of each conduit; and (v) means for securing the removable cartridge to the recess region such that the cartridge is fastened to the front wall of the elongated steam chamber; and (b) activating the actuators to allow steam through the conduits thereby delivering steam onto the moving sheet.

17. The method of claim 16 wherein step (b) comprises activating the actuators selectively so that steam is distributed along a length of the moving sheet in a predetermined pattern.

18. The method of claim 17 wherein the pressure within each compartment within the cartridge ranges up to about 80 kPa.

19. The method of claim 17 wherein the front screen that define an outer profiling surface having a contour that matches that of the moving sheet.

20. The method of claim 19 wherein the front screen is positioned a distance of 10 mm to 20 mm from an exterior contour of the moving sheet.

* * * * *